US008631804B2

(12) United States Patent
Umezu et al.

(10) Patent No.: US 8,631,804 B2
(45) Date of Patent: Jan. 21, 2014

(54) CLIP FOR WIG

(75) Inventors: Kazuhiro Umezu, Shinjuku-ku (JP); Yoshimi Sasaki, Shinjuku-ku (JP); Tetsuhiro Matsuda, Shinjuku-ku (JP)

(73) Assignee: Unihair Co., Ltd., Tokyo (JP)

( * ) Notice: Subject to any disclaimer, the term of this patent is extended or adjusted under 35 U.S.C. 154(b) by 574 days.

(21) Appl. No.: 12/297,218

(22) PCT Filed: May 8, 2007

(86) PCT No.: PCT/JP2007/059512
§ 371 (c)(1),
(2), (4) Date: Oct. 19, 2009

(87) PCT Pub. No.: WO2007/129708
PCT Pub. Date: Nov. 15, 2007

(65) Prior Publication Data

US 2010/0139679 A1 Jun. 10, 2010

(30) Foreign Application Priority Data

May 8, 2006 (JP) ..... 2006-129702

(51) Int. Cl.
*A41G 3/00* (2006.01)

(52) U.S. Cl.
USPC ..... 132/54

(58) Field of Classification Search
USPC ..... 132/273, 276, 280, 281, 53, 54, 56, 201
See application file for complete search history.

(56) References Cited

U.S. PATENT DOCUMENTS 4,788,991 A * 12/1988 Nocera et al. ..... 132/156
5,137,037 A * 8/1992 Mochizuki ..... 132/53
D356,398 S * 3/1995 Hafid ..... D28/92

(Continued)

FOREIGN PATENT DOCUMENTS

CN 2106532 6/1992
CN 1611160 5/2005

(Continued)

OTHER PUBLICATIONS

International Search Report (ISR) for PCT/JP2007/059512 for Examiner consideration.

(Continued)

*Primary Examiner* — Robyn Doan
*Assistant Examiner* — Brianne Kalach
(74) *Attorney, Agent, or Firm* — Chen Yoshimura LLP

(57) ABSTRACT

A clip for wig is offered which can prevent warping of a wig base.

The clip 1 for wig is constituted with a frame-like reversible member 10 and a plurality of comb teeth 20 attached to the reversible member 10, the reversible member 10 is constituted with an U-shaped frame material 11 having leg portions 11B and 11C protruding from both ends of a support portion 11A and a connecting portion 12 connected to respective leg portions 11B and 11C of the U-shaped frame material 11, a plurality of comb teeth 20 are fixed at the end portion of the support portion 11A of the U-shaped frame material 11, the outer shape of the support portion 11A is formed to have a curvature of the circular arc along the curved periphery of the wig base 30, and the support portion of the clip 1 of a wig is provided at the position close to the periphery, thereby to be fixed to the reverse side of the wig base.

5 Claims, 17 Drawing Sheets

(56) References Cited

U.S. PATENT DOCUMENTS

| | | | | |
|---|---|---|---|---|
| 5,873,373 | A * | 2/1999 | Narvick | 132/54 |
| 2003/0131861 | A1* | 7/2003 | Prestia | 132/53 |
| 2005/0115581 | A1* | 6/2005 | Choi | 132/53 |
| 2007/0221244 | A1* | 9/2007 | Lane et al. | 132/276 |

FOREIGN PATENT DOCUMENTS

| | | | |
|---|---|---|---|
| JP | 56-23294 | Y2 | 6/1981 |
| JP | 59-1706 | A | 1/1984 |
| JP | 61-11734 | U | 1/1986 |
| JP | 02-22323 | U | 2/1990 |
| JP | 02-106430 | U | 8/1990 |
| JP | 03-57961 | B2 | 9/1991 |
| JP | 05-37922 | U | 5/1993 |
| JP | 09-287601 | A | 11/1997 |
| JP | 3053911 | U | 9/1998 |
| JP | 2873798 | B2 | 1/1999 |
| JP | 2001-329422 | A | 11/2001 |

OTHER PUBLICATIONS

PCT/ISA/237 in PCT/JP2007/059512 and its translation of Section V.

Chinese Office Action, dated Jan. 29, 2010, in a counterpart Chinese patent application. Concise Explanation of Relevance: the Chinese Office Action rejects claims 1, 2, and 6-8 in the Chinese application.

* cited by examiner

CLIP FOR WIG

TECHNICAL FIELD

The present invention relates to a clip for a wig used for fixing a wig to a wearer's head, and especially to a clip for a wig used by fixing it to the reverse side of a wig base along its curved periphery remarkably swelling from the hairline corner of the forehead of the wig base, and to the wig provided with said clip.

BACKGROUND ART

A clip for a wig is used by being attached to the reverse side of a wig base with numerous hair planted thereto, for fixing a wig to the head by clipping to the wearer's own hair around a thin hair portion.

For example, as shown in FIG. 30, a conventional clip 100 for a wig is constituted with a reversible member 110 and a plurality of comb teeth 120 protruding needle-like held at an end and attached to said reversible member 110. The reversible member 110 can maintain the warping posture, and by reversing alternatively the warping direction, the tips of the comb teeth 120 can be firmly attached to, or detached from, the reversible member 110. The reversible member 110 is shaped rectangular or elliptical frame-like. Here, in order to increase the attaching force to the comb teeth 120 as well as to clip softly the wearer's own hair, the reversible member 110 is provided with a friction member 130 having a portion made of an elastic matter in contact with the comb teeth 120.

As such clips for wig, Patent References 1 to 6 disclose those which are provided with a reversible member and the comb teeth the ends of which are held to said reversible member, and can fix the wig to the wearer's head by reversing the warping direction of the reversible member so as to clip the wearer's own hair with the comb teeth.

[Patent Reference 1] Japan Utility Model Gazette S56-23294 (1981)

[Patent Reference 2] Japan Patent Laid Open 2001-329422 (2001)

[Patent Reference 3] Japan Patent 2873798

[Patent Reference 4] Japan Utility Model Registration 3053911

[Patent Reference 5] Japan Patent Laid Open S59-1706 (1984)

[Patent Reference 6] Japan Patent H03-57961 (1991)

DISCLOSURE OF THE INVENTION

Problems to be Solved

A wig base is constituted in general in the size fitting the wig wearer's thin hair portion, made of a net material or an artificial skin of soft synthetic resin, with numerous hair 33 on the surface. For a partial wig illustrated in FIG. 31, a wig base 30 is formed to hide a thin hair portion when the wig wearer has the thin hair state from the forehead including a hairline to the top portion, and to have a curved shape from the side head to the back head remarkably swelling outward from the corner 32 in the region of the forehead hairline 31 along the wig wearer's normal hairline and the left and right corners 32 of said forehead hairline 31. (This region is referred to as a forehead hairline corner portions in the present specification.) The reason to provide such a forehead hairline corners 32 and a swollen portion S3 markedly swelling outward from said corners 32 toward the sideburns of the side head portions to the wig base 30 is to make the wig base coincide with the state of growth distribution of the wearer's own normal hair along the side head line from the left and right of the wearer's own hairline corners toward the sideburns. Thereby, the normal hairline from the forehead toward the side head portions and the back head is reproduced in the wig wearer's thin hair portion.

The clips for wigs 100 are provided in an appropriate number to the reverse side of said wig base 30 shown in FIG. 31 to clip a relatively many strands of the wearer's own hair surrounding the thin hair portion. If such a wig is manufactured that said clip 100 for a wig is attached toward inside apart from the periphery of the wig base 30 and is worn on the head, then the periphery of the wig base 30 tends to warp by the external force, and the wig might possibly float from the head skin, which necessitates providing to the position along the periphery of the reverse side of the wig base 30 as far as possible. Especially, in the case of a wig with the corners 32 of the forehead hairline and a swollen portion S3 markedly swelling outward from said corners 32 toward the sideburns of the side head portions, the tendency of warping of the swollen portion S3 has been highly increased.

Therefore, in prior arts, a clip 100 for a wig is provided at the position as close as possible to the curved periphery of the swollen portion S3, as shown in FIG. 31, in order to prevent warping of the swollen portion S3. However, since the shape of the periphery of the swollen portion S3 of the wig base 30 does not coincide with the shape of the outer frame of the clip 100 for a wig, the area of the protruding portion from the clip 100 for a wig to the periphery of the wig base 30 can not help but become large, this protruding portion easily warping, and hence possibility of exposure of the wig can not be prevented.

The present invention was created referring to the above-mentioned problems, and has an object to provide a clip for a wig and a wig provided with it, with which warping can be prevented in the curved swollen portion swelling outward from the forehead hairline corners 32, especially, toward the sideburns of side head portions of a wig base.

Means to Solve Problems

In order to achieve the above-mentioned object, the present invention provides a clip for a wig constituted with a frame-like reversible member and a plurality of comb teeth attached to said reversible member, characterized in that the outer shape of the reversible member is formed in a circular arc so as to fit the curved periphery of the wig base.

Said reversible member is formed in a reversible curved frame preferably with a U-shaped frame member, original Japanese language reads "コ" which is a Japanese katakana letter "ko", having a support portion to support a plurality of comb teeth held at one end and a pair of leg portions protruding from both ends of said support portion in the same direction, and a connecting portion to pull inward both leg portions of said U-shaped frame member to connect, and further the outer shape of the support portion is formed in a circular arc so as to fit the curved periphery of the wig base.

The circular arc-like outer shape of said support portion is preferably curved with the curvature of the same level as that of the curved periphery swelling from the forehead hairline corners toward the sideburns of side head portions of the wig base, and preferably formed in a circular arc with the curvature radius 1.5 cm to 4.5 cm. The connecting portion may be formed in the same shape as the circular arc of the support portion.

A penetrating hole is formed in each of said leg portions, and a sheet is bound and held on the reverse side of the reversible member with a connecting piece inserted into each penetrating hole, and thus said sheet may be attached to the wig base. Otherwise, the clip for a wig may be fixed on the reverse side of the wig base by passing sewing thread through said penetrating hole and sewing a pair of leg portions to the reverse side of the wig base. The penetrating hole is preferably provided at the position near the support portion of each leg portion.

Further, the wig of the present invention is provided with a clip for a wig, said clip for a wig being constituted with a frame-like reversible member, which is reversible from a surface to a reverse side or vice versa, and a plurality of comb teeth attached to one piece so to protrude from said one piece of the reversible member over the other piece, characterized in that the outer shape of one piece of the reversible member is formed in a circular arc with the curvature radius of the same level as that of the curved periphery swelling from the forehead hairline corners toward the sideburns backward at the side head portions of the wig base, and the reversible member is attached to the reverse side of the wig base along the curved periphery swelling from the forehead hairline corners backward. Here, the forehead hairline corners may be formed at least on either left or right side of the wig base.

Effect of the Invention

The clip of the present invention for a wig can be attached to the wig base so as to coincide with the curved shape of the periphery of the wig base because the outer shape of the reversible member is formed in circular arc. Especially, by using the clip of the present invention for a wig, since the outer shape of the reversible member is curved with the curvature of the same level as that of the curved periphery, that is, the turn back portion swelling outward from the forehead hairline corners toward the sideburns backward at the side head portions of the wig base, and hence it can be attached only slightly inside along said turn back portion, the protruding portion from the clip for a wig to the periphery of the wig base can be made smaller than the conventional clip for a wig as shown in FIG. 31. Therefore, the warping of the wig can be prevented to occur, and the exposure of wearing a wig can be avoided.

| Explanation of Marks and Symbols | |
|---|---|
| 1, 2, 2A, 2B | Clip for wig |
| 10 | Reversible member |
| 11A | Support portion |
| 11B, 11C | Leg portion |
| 12 | Connecting portion |
| 13 | Connecting hole |
| 14 | Corresponding connecting hole |
| 15 | Connecting piece |
| 16 | Friction member |
| 18 | Connecting hole |
| 19 | Attaching piece |
| 20 | Comb teeth |
| 21 | Swelling portion |
| 30 | Wig base |
| 31 | Forehead hairline portion |

-continued

| Explanation of Marks and Symbols | |
|---|---|
| 32 | Forehead hairline corner portion |
| 32A | Turn back portion |
| 33 | Hair |
| 35 | Sheet |
| 36 | Washer |
| 37 | Connecting piece |
| 40 | Measuring apparatus |
| 41 | Measuring instrument |
| 42 | Load sensor |
| 43 | Extension rod |
| 44 | Contact terminal |
| 45 | Display |
| 50 | Stage |
| 51, 52 | Rubber plate |
| 53 | Tape |

BEST MODES FOR CARRYING OUT THE INVENTION

Hereinafter, the present invention will be explained with reference to the embodiments illustrated in the figures.

Embodiment 1

Figure 1:
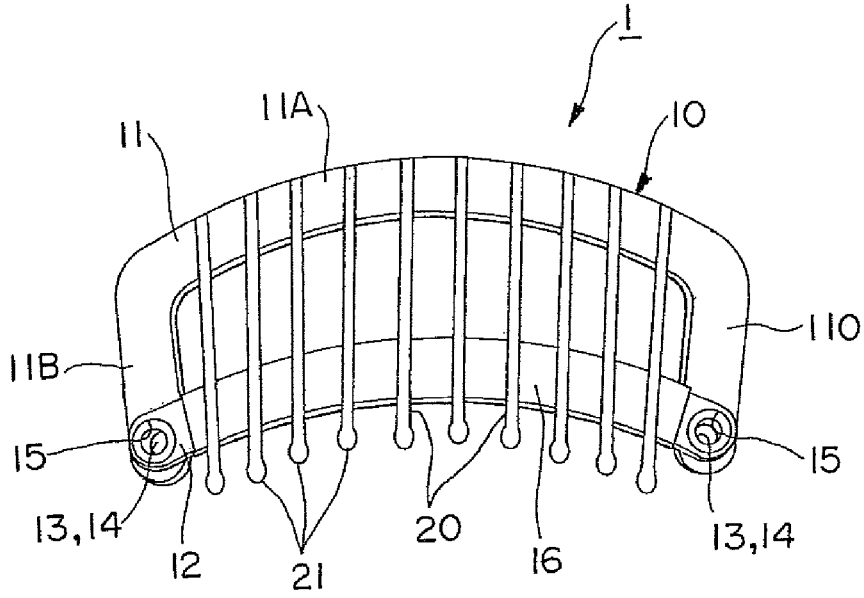
FIG. 1 illustrates the clip for a wig in accordance with the first embodiment of the present invention.

FIG. 1 illustrates the clip 1 of the present invention for a wig in this first embodiment. Said clip 1 for a wig is constituted with a reversible member 10 and a plurality of linear comb teeth 20 attached to said reversible member. The reversible member 10 is made of an elastically deformable metallic thin plate to frame-shaped, and the comb teeth 20 are made of elastically deformable metallic thin wires or rods.

The reversible member 10 is constituted with an U-shaped frame member 11, the original Japanese language reads "コ" which is a Japanese katakana letter "ko", having leg portions 11B and 11C protruding from both ends of a belt-like support portion 11A in the same direction to make a right angle to the support portion 11A in the same plane and a belt-like connecting portion 12 connected to each of leg portions 11B and 11C of said U-shaped frame member 11.

A connecting hole 13 is provided to the each tip of leg portions 11B and 11C of the U-shaped frame member 11, and a corresponding connecting hole 14 corresponding to the connecting hole 13 of each of leg portions 11B and 11C is provided at both ends of the connecting portion 12. The support portion 11A of the U-shaped frame member 11 is made a little longer than the connecting portion 12 so that the interval of the connecting holes 13 of the U-shaped frame member 11 is longer than the interval of corresponding connecting holes 14 of the connecting portion 12.

The U-shaped frame member 11 and the connecting portion 12 are connected and fixed by pulling inward both leg portions 11B and 11C of the U-shaped frame member 11, curving the support portion 11A in either direction upward or downward, and inserting such a connecting piece 15 as a metal eyelet and a rivet into the connecting hole 13 of the U-shaped frame member 11 and the corresponding connecting hole 14 of the connecting portion 12.

A plurality of comb teeth 20 have their tips fixed each to the support portion 11A of the U-shaped frame member 11, and are set in parallel to the support portion 11A by being supported held at one end so as to protrude outward from the support portion 11A beyond the connecting portion 12. The length of each of the comb teeth 20 is set at about equal length. At each tip of the comb teeth 20 is preferably formed a spherical swollen portion 21. Also, a friction member 16 made of such an elastic matter as rubber and urethane is coated on the connecting portion 12.

As described above, since the interval of the connecting holes 13 formed in the leg portions of the U-shaped frame member 11 and the interval of the corresponding connecting holes 14 of the connecting portions 12 are different, the reversible member 10 is curved so that the U-shaped frame member 11 and the connecting portions 12 warp in the same direction. From such a curving state, the reversible member 10 can be reversed so that the U-shaped frame member 11 and the connecting portions 12 warp in the opposite direction. By changing the warping direction of the reversible member 10, the comb teeth 20 can be pressed and attached to, or separated from, the friction member 16.

Although the above-described aspect is the same as that of the conventional clip 100 for a wig, the clip 1 of the present embodiment for a wig is characterized in that the support portion 11A is formed to be curving as the outer frame of the reversible member 10. As shown in FIG. 1, the outer shape of the support portion 11A of the reversible member 10 is formed in a circular arc so as to swelling outward as moving from the left and right ends to the center. Here, the curvature of this curve is made as close as possible to fit the curved periphery of the wig base to which the clip 1 for a wig is attached. An arced edge of the support portion 11A is formed so as to coincide with the curved shape of the periphery of the wig base. Also, in the present embodiment, the connecting portion 12 is formed approximately in the same shape as that of the support portion 11A.

Explanation is made here of the wig to which the clip 1 of the present invention for a wig is attached. The wig is constituted basically with a wig base 30 and numerous hair 33 attached to the outer side of the wig base 30 to extend upward. The wig base 30 is formed in the shape shallowly swelling along the wearer's head shape to cover the thin hair region of the head with an artificial skin formed with a soft synthetic resin film or a net as a main part. Incidentally, the thin hair region appears in general to be enlarged in circular shape around the head top with the hairline retreating backward. Therefore, since the shape of the wig base 30 is formed to cover it along said thin hair portion, the forehead hairline swelling upward in FIG. 2 and the turn back portion 32A protruding and swelling outward from the constriction of the forehead hairline corners 32 at both sides further to both side head portions are in general connected, and formed to make a curve from said left and right turn back portions 32A to the back head. Here, the turn back portion 32A points to the curved line formed in the back head direction from the forehead hairline corners 32 as the initial point, and is positioned just at the upper side of the sideburns, that is, above ears.

Figure 2:
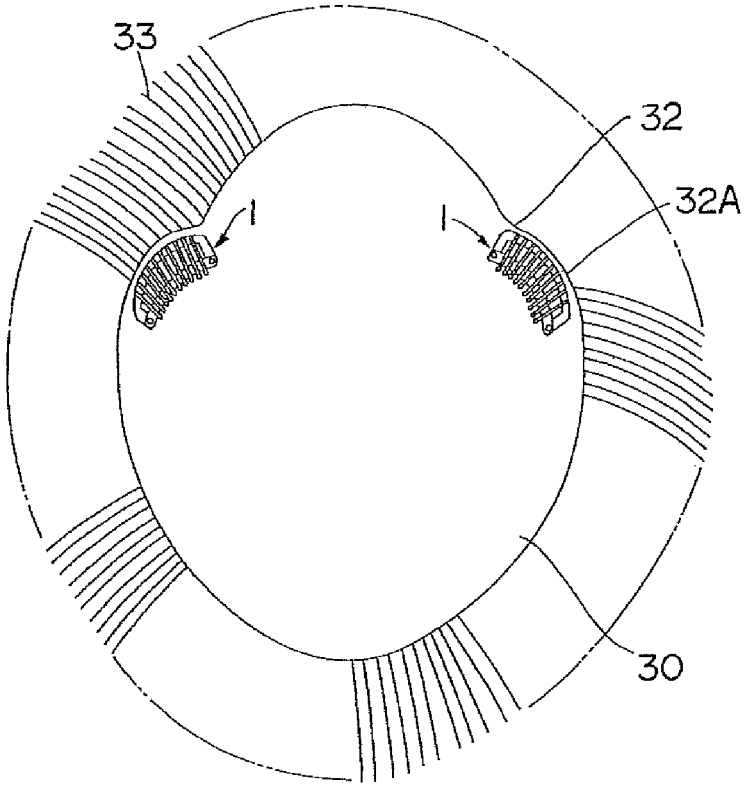
FIG. 2 illustrates the state of the clip for a wig of FIG. 1 attached to a wig base.

The clip 1 for a wig constituted as above is, as shown in FIG. 2, attached especially along the periphery of the curved turn back portions 32A swelling markedly from the forehead hairline corners 32 of the wig base 30 to their reverse sides. Concretely, it is fixed with, for example, sewing thread or an adhesive with the outer frame of the clip 1 for a wig, that is, the support portion 11A of the reversible member 10 positioned along near the curved periphery of the turn back portion 32A of the reverse side of the wig base. In this case, since the shape of the support portion 11A of the clip for a wig is curved with about same curvature as the curved periphery of the turn back portion 32A of the wig base 30, the clip for a wig can be positioned at the quite close peripheral position to said turn back portion 32A.

Figure 31:
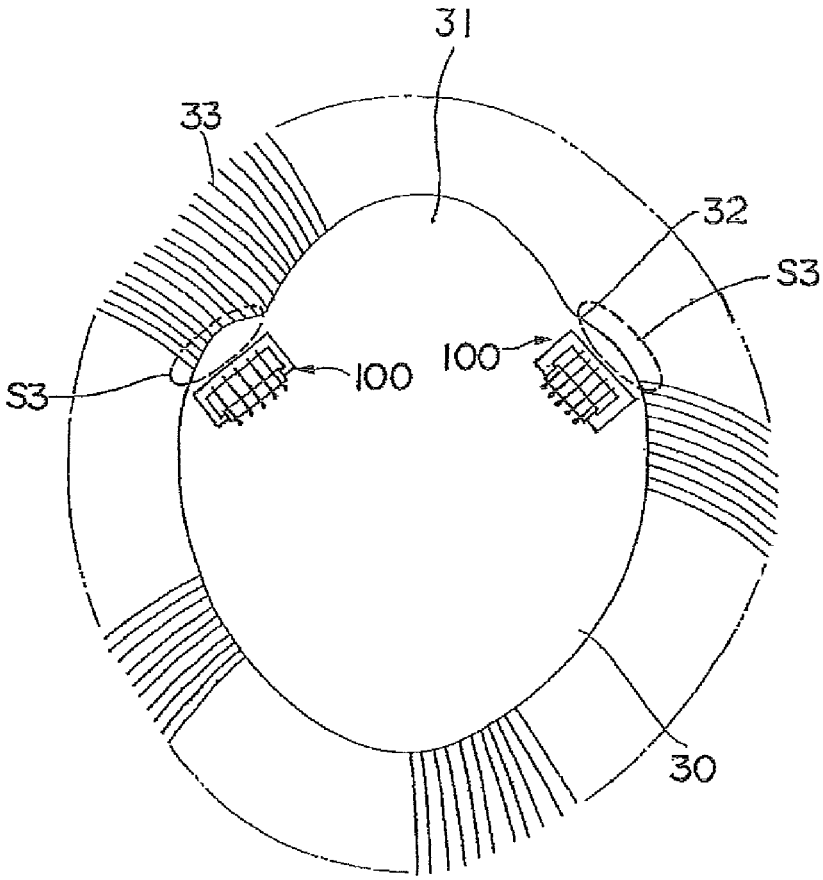
FIG. 31 illustrates the state of the clip for a wig of FIG. 30 attached to a wig base.

By the clip 1 for a wig in accordance with the present embodiment, as shown in FIG. 2, since the support portion 11A of the clip 1 for a wig can be positioned at quite close peripheral position along the curved shape of the turn back portion 32A from the forehead hairline corner 32 of the wig base, the protruding portion from the clip 1 for a wig to the periphery of the wig base 30 can be made smaller than the conventional wig shown in FIG. 31. Therefore, by the clip 1 for a wig in accordance with the present embodiment, occurrence of warping of a wig around the forehead hairline corners including the turn back portion 32A can be prevented, and hence the exposure of the wig can be avoided.

Explanation is further made next of the concrete constitution of the above-mentioned clip 1 for a wig.

First of all, comb teeth 20 are explained. Here, the direction perpendicular to the extension of the comb teeth 20 is defined as "horizontal direction" of the clip 1 for a wig, and the length of the clip 1 for a wig in said direction is defined as "horizontal length".

Figure 3:
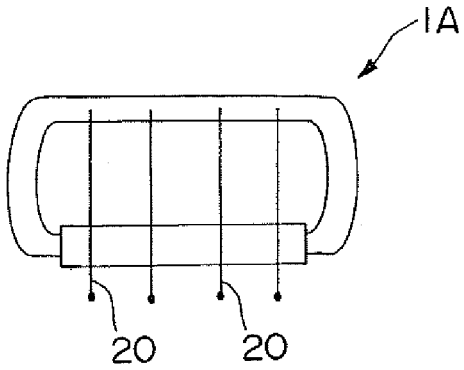
FIG. 3 is the drawing to illustrate the number of comb teeth of the clip for a wig in accordance with the first embodiment.

The clip 1A for a wig shown in FIG. 3 has for example, 35 mm horizontal length, and four comb teeth 20 are provided along said horizontal length. In this case, since the area to bind and hold the wearer's own hair is too small, sufficient force can not be attained to fix the wearer's own hair with said clip 1A for a wig.

Figure 4:
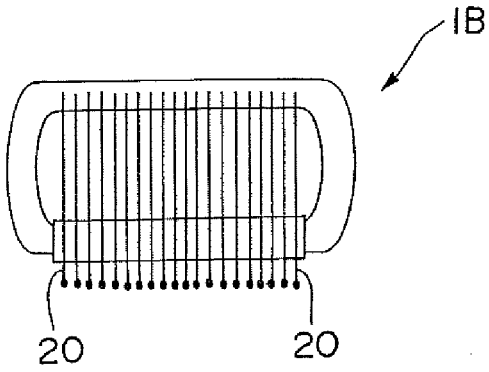
FIG. 4 is the drawing to illustrate the number of comb teeth of the clip for a wig in accordance with the first embodiment.

On the other hand, in the case of the clip 1B for a wig shown in FIG. 4, the horizontal length is 35 mm, same as for the clip of FIG. 3, twenty comb teeth 20 are provided. In this case, by narrowing the intervals of comb teeth, the number of the wearer's own hair picked up with the comb teeth 20 decreases, the wearer's own hair becomes difficult to be bound, and hence the stability tends to lower when the wig is worn. Considering the above, when the horizontal length of the clip 1 for a wig is about 35 mm, it is desirable to design the number of the comb teeth 20 as about 6 to 15.

Explanation is made of the curved shape of the clip 1 for a wig of the present embodiment.

Figure 5:
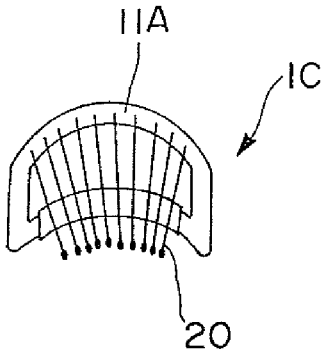
FIG. 5 is the drawing to illustrate the curve shape of the clip for a wig in accordance with the first embodiment.

In the clip 1C for a wig shown in FIG. 5, the curvature radius of the support portion 11A as an outer frame is designed as 1.5 cm. If the curvature radius of the support portion 11A is 1.5 cm or less so to make curving sharp, then the comb teeth intervals are narrow, and the wearer's own hair is hard to bind.

Figure 6:
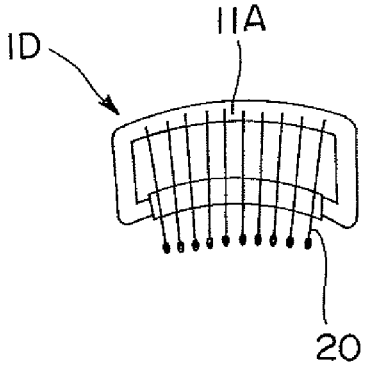
FIG. 6 is the drawing to illustrate the curve shape of the clip for a wig in accordance with the first embodiment.
Figure 30:
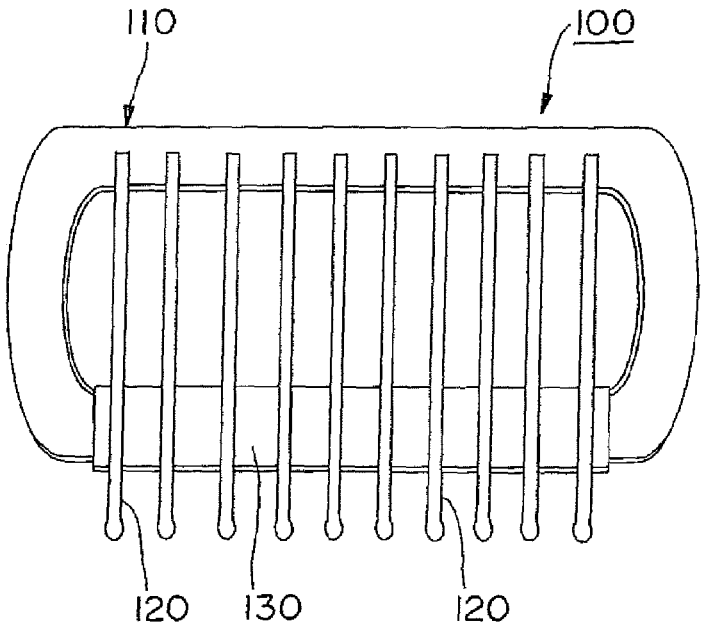
FIG. 30 illustrates a conventional clip for a wig.

On the other hand, in the clip 1D for a wig shown in FIG. 6, the curvature radius of the support portion 11A as an outer frame is designed as 4.5 cm. If the curvature radius of the support portion 11A as an outer frame is 4.5 cm or more so to make curving loose, then it is practically same as the linear outer frame of the conventional clip 100 for a wig as shown in FIG. 30, and when it is attached around the forehead hairline corners, a problem is caused that the wig base 30 tends to warp just as the conventional clip 100 for a wig does.

Therefore, it is preferable to design the outer shape of the support portion 11A of the clip 1 for a wig as having a curvature radius in the range of 1.5 cm to 4.5 cm, and the measurement result of the curvature radius of the turn back portion 32A for the wearer of an ordinary head shape showed that most are around 3.0 cm, so that the preferred curvature radius is 3.0 cm.

If the interval of the tips of the comb teeth 20 of said clip 1 for a wig is narrower than 1.5 mm, the number of strands of the wearer's own hair which can be picked up with the comb teeth 20 is reduced due to the shorter distance of the comb teeth, resulting in lower stability while the wig is being worn. On the other hand, if the interval of the comb teeth tips is wider than 3 mm, then the area to bind and fix the wearer's own hair with the comb teeth 20 is reduced, and the clip for a wig can not have sufficient clipping force. Therefore, the interval of the tips of the comb teeth 20 of the clip 1 for a wig is preferably designed as in the range of 1.5 mm to 3.0 mm, and more preferably, for example, about 2.0 mm.

Explanation is made of the setting angle of comb teeth 20 of the clip 1 for a wig. When the clip for a wig is viewed from front, the line to divide equally symmetrically to the left and right is defined as a center line C. The clips 1E and 1F for a wig shown in FIGS. 7 and 8 have comb teeth 20 supported at one end with a support portion 11A, and the state is illustrated in which those tips are directed toward the center line C. The clip 1G for a wig shown in FIG. 9 has comb teeth 20 set in parallel to the center line C.

Figure 7:
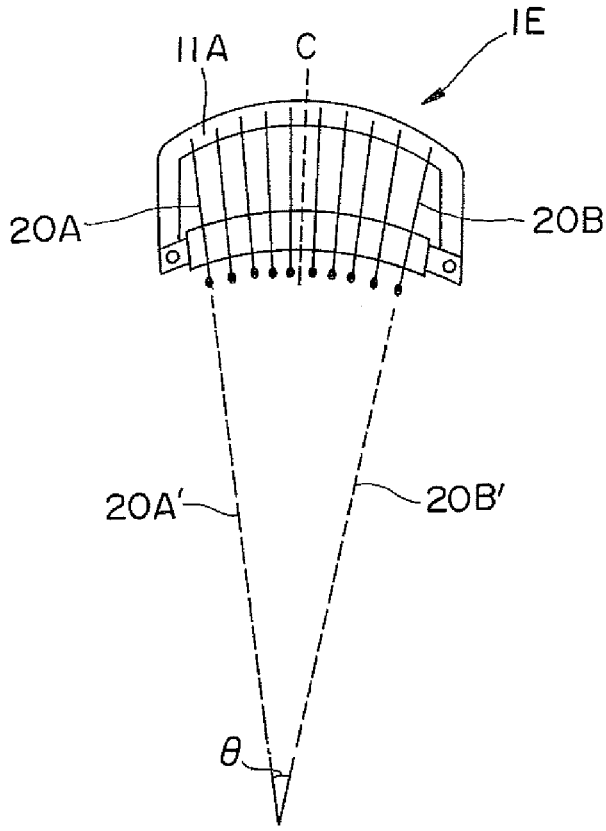
FIG. 7 is the drawing to illustrate the setting angle of the comb teeth of the clip for a wig in accordance with the first embodiment.
Figure 8:
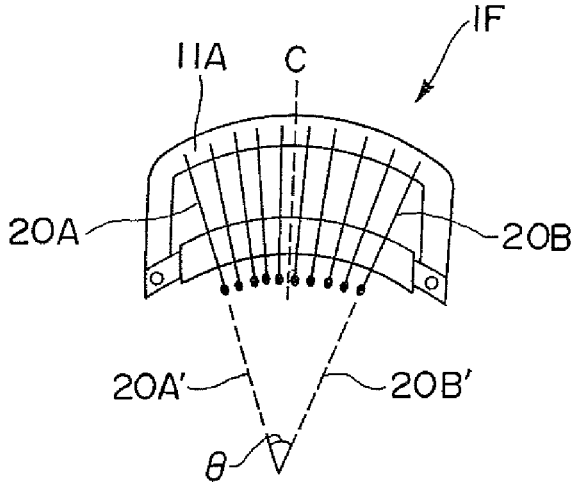
FIG. 8 is the drawing to illustrate the setting angle of the comb teeth of the clip for a wig in accordance with the first embodiment.
Figure 9:
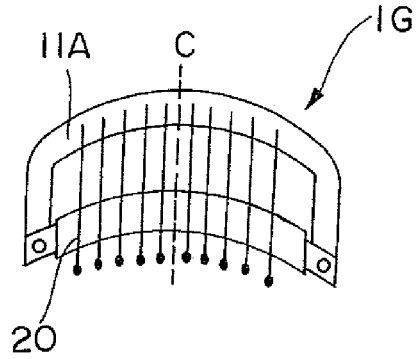
FIG. 9 is the drawing to illustrate the setting angle of the comb teeth of the clip for a wig in accordance with the first embodiment.

In the clip 1E of FIG. 7 for a wig, the angle θ at which the extension 20A' and 20B' of the comb teeth 20A and 20B at both ends is designed as 20 degrees. When inclination of the comb teeth 20 toward the center line C is increased, the angle θ at which the extension 20A' and 20B' cross increases. If the angle at which the extension 20A' and 20B' of the comb teeth 20A and 20B of the clip 1F for a wig shown in FIG. 8 cross is made more than said θ (=20 degrees), for example, about 40 degrees, then the interval of the tips of the comb teeth 20 becomes less than 1.5 mm, and it becomes difficult to bind the wearer's own hair. Also, as shown in FIG. 9, in the case that each comb tooth 20 is in parallel to the center line C, if the interval of the tips of the comb teeth 20 is within the range of 1.5 mm to 3.0 mm, then the wearer's own hair can be bound and held as easily as with the clip 1E for a wig shown in FIG. 7, so that it is not necessarily required to arrange the tips of comb teeth by inclining the comb teeth 20 toward the center line C, but rather the comb teeth 20 may be arranged in parallel to the center line C.

Figure 10:
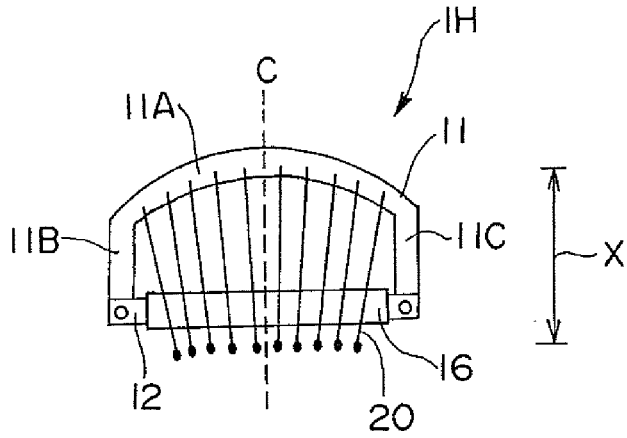
FIG. 10 is the drawing to illustrate the shape of a connecting portion of the clip for a wig in accordance with the first embodiment.
Figure 11:
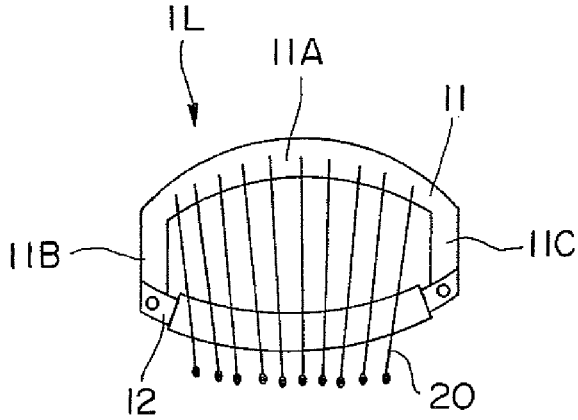
FIG. 11 is the drawing to illustrate the shape of a connecting portion of the clip for a wig in accordance with the first embodiment.

FIG. 10 illustrates the clip 1H for a wig the connecting portion 12 of which is linear, and FIG. 11 illustrates the clip 1L for a wig provided with the connecting portion 12 the outer shape of which swells in the opposite direction of the swelling direction of the support portion 11A. In the clip 1H for a wig shown in FIG. 10, due to the difference in shapes of the support portion 11A and the connecting portion 12, the distance X in the longitudinal direction between the support portion 11A and the connecting portion 12 becomes shorter from the center line C toward the leg portions 11B and 11C. When the comb teeth 20 of the same length are attached to the support portion 11A of said clip 1H for a wig, since the distance X differs for each attaching position of the comb teeth 20, the lengths of the comb teeth 20 protruding from the friction member 16 differ. The clip 1H for a wig of FIG. 10 has different clipping force of the wearer's own hair depending upon the difference of lengths of the comb teeth 20, when the wearer's own hair is bound and held with the friction member 16 and the comb teeth 20. For example, the clipping force decreases in the part where the comb teeth 20 are long, and the clipping force increases in the part where the comb teeth 20 are short. Thus, in the clip 1H for a wig shown in FIG. 10, unbalance of clipping force of the comb teeth 20 is caused, and thereby the distortion of the clip 1H for a wig is caused, and the wearer's own hair can not be properly bound and held. Also in the clip 1H for a wig shown in FIG. 10, it is necessary to attach the comb teeth 20 of different lengths at the predetermined position of the support portion 11A, and hence manufacturing is difficult compared with the clip 1 for a wig shown in FIG. 1.

In the clip 1L for a wig shown in FIG. 11, since the connecting portion 12 swells outward, the area is larger than the clip 1H for a wig shown in FIG. 10. In the case to use the clip 1L for a wig of large area attached to the reverse side of the wig base 30, since the curved shape of the clip 1L for a wig does not fit the curved shape of the wig base 30, the range is enlarged where the head shape is unfitted, and the close contact between the wig and the head deteriorates. Also, since said clip 1L for a wig has increased area compared with the clip 1H for a wig of FIG. 10, a larger part of the wearer's own hair bound and held with the clip 1L for a wig is pulled, thereby uncomfortable feelings are raised. Therefore, the shape of the connecting portion 12 is preferably formed in same as the support portion 11A as in the clip 1 for a wig shown in FIG. 1.

FIG. 12(A) is the drawing to illustrate the clip 1M for a wig provided with comb teeth 20 to the plate-like reversible member 11', and FIG. 12(B) is the cross-sectional view along line A-A of FIG. 12(A).

Figure 12:
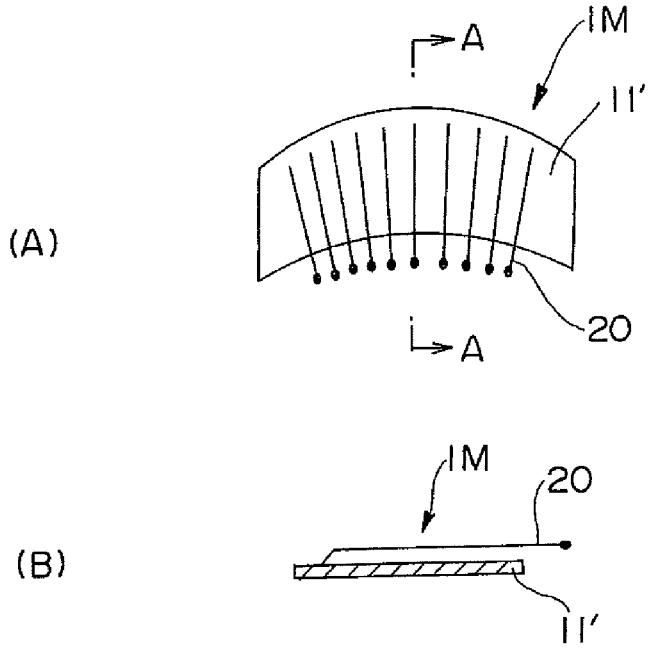
FIG. 12 is the drawing to illustrate the shape of a reversible member of the clip for a wig in accordance with the first embodiment.

The clip 1M for a wig shown in FIG. 12 has strong reversing force compared with the clip 1 for a wig shown in FIG. 1 due to a large area of the reversible member 11', and hence it is difficult to reverse the reversible member 11' with the wearer's fingers.

Since the contact area of the reversible member 11' and the comb teeth 20 is large compared with the frame-like reversible member 11, the amount of the wearer's own hair bound and held with the reversible member 11' and the comb teeth 20 is more than with the clip 1 for a wig shown in FIG. 1. However, as the area of the part for clipping becomes larger, the clipping force of the wearer's own hair lowers since the force for clipping disperses, and the wearer's own hair tends to slip off from the plate-like reversible member 11'. On the other hand, in the clip 1 for a wig shown in FIG. 1, an opening is formed in the central portion of the reversible member 11, and the reversing force of the clip 1 for a wig can be adjusted by modifying the size of said opening.

Also, in the clip 1 for a wig shown in FIG. 1, the dispersion of clipping force of the wearer's own hair generated upon using the plate-like reversible member 11' shown in FIG. 12 is eliminated by making the clipping portion of the wearer's own hair only the pressed portions of the friction member 16 attached to the connecting portion 12 and the comb teeth 20, thereby the wearer's own hair can be firmly fixed. Hence, a frame-like thing is preferably used as the reversible member of the clip for a wig.

Explanation is made of the breadth of an U-shaped frame material 11 and a connecting portion 12 of the clip 1 for a wig of the present embodiment. The breadth of an U-shaped frame material 11 and a connecting portion 12 relates to the reversing force and durability of the clip 1 for a wig. Since as the breadth of an U-shaped frame material 11 and a connecting portion 12 narrows, the reversing force lowers, if the breadth is narrower than 3 mm, the reversing force required to clip the wearer's own hair can not be attained. Durability also deteriorates with narrower breadth, and especially, at the portion provided with a penetration hole 18 mentioned below, there is a possibility to break the clip 1 for a wig due to low strength around the penetration hole. On the other hand, as the breadth of an U-shaped frame material 11 and a connecting portion 12 widens, the reversing force increases. However, when the reversing force is markedly increased by the widened breadth of an U-shaped frame material 11 and a connecting portion 12, the clip 1 for a wig can no longer be reversed with fingers. Therefore, in order to maintain the reversing force to clip the wearer's own hair and the durability sufficient for use as the clip 1 for a wig, the breadth of an U-shaped frame material 11 and a connecting portion 12 is preferably about 3 mm.

Figure 13:
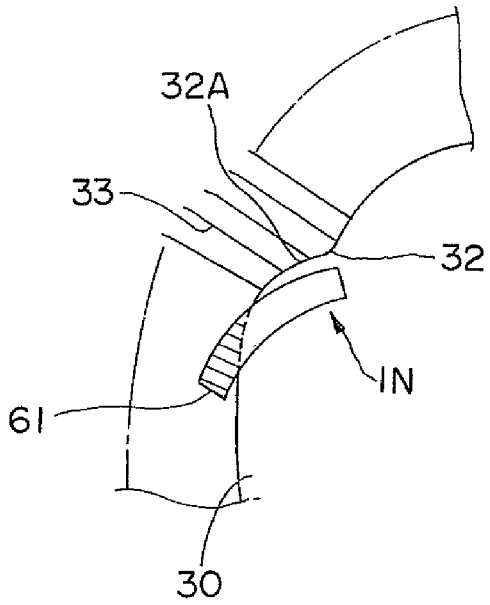
FIG. 13 is the drawing to illustrate the horizontal length of the clip for a wig in accordance with the first embodiment.
Figure 14:
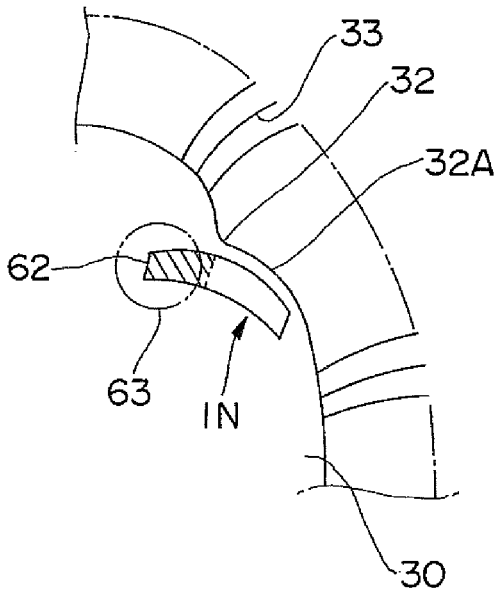
FIG. 14 is the drawing to illustrate the horizontal length of the clip for a wig in accordance with the first embodiment.

FIGS. 13 and 14 are the drawings to illustrate the state wherein a clip 1N for a wig long in the horizontal direction is fixed to a wig base 30 along the curved shape of the turn back portion 32A of the wig. Here, the illustration of comb teeth and others are omitted in the figures.

In the case that the clip for a wig is too long in the horizontal direction, for example, the end portion 61 (slashed line) of the clip 1N for a wig in FIG. 13 protrudes from the periphery of the wig base 30, or, as shown in FIG. 14, the wig base 1N does not protrude from the periphery, the end portion 62 (slashed line) of the clip 1N for a wig is arranged inside apart from the periphery of the wig base 30.

In FIG. 13, the end portion 61 of the clip 1N for a wig is visible from outside, resulting in exposure of wearing a wig. As in FIG. 14, if the end portion 62 of the clip 1N for a wig is arranged inside apart from the periphery of the wig base 30, the surrounding region 63 of the end portion 62 of the clip 1N for a wig is the region where it is not necessary to bind and hold the wearer's own hair to wear the wig, and since the curved shape of the clip 1N for a wig and the curved shape of the wig base 30 do not coincide at the end portion 62, distortion is caused in the shape of the wig base 30 when the wearer's own hair in the surrounding region 63 of said end portion 62 is bound and held with the clip 1N for a wig.

Figure 15:
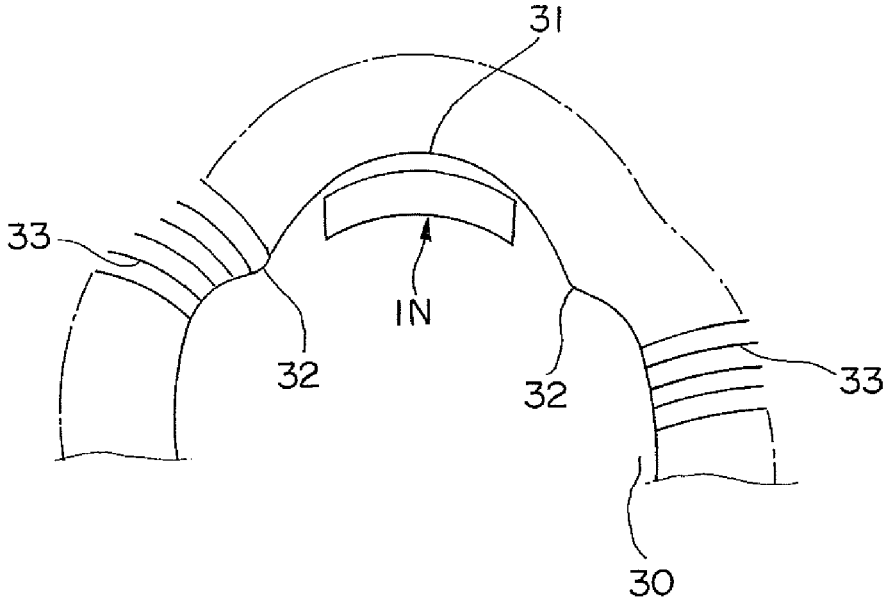
FIG. 15 is the drawing to illustrate the horizontal length of the clip for a wig in accordance with the first embodiment.

Therefore, the portion in which the clip 1N for a wig long in the horizontal direction can be used is preferably the part having a curved shape in so wide a range that the clip 1N for a wig does not protrude, for example, like the forehead hairline 31 or others of FIG. 15.

Figure 16:
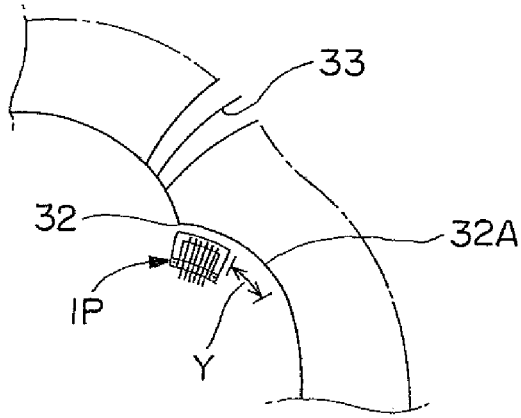
FIG. 16 is the drawing to illustrate the horizontal length of the clip for a wig in accordance with the first embodiment.

FIG. 16 is the drawing to illustrate the state wherein the clip 1P for a wig shorter in the horizontal direction is fixed along the curved shape of the turn back portion 32A of the wig base 30. Here, the illustration of comb teeth and others is omitted in the figure.

The shorter the clip for a wig in the horizontal direction, the stronger the reversing force, and it is difficult to reverse with a single hand when the wig is worn. If the clip for a wig is short in the horizontal direction, the area to bind and hold the wearer's own hair is small, and hence, as shown in FIG. 16, the range Y is formed where the wearer's own hair can not be bound and held around the turn back portion 32A. Warping of the wig base 30 tends to occur because the wearer's own hair in the range Y is not bound and held. Since clipping force of the wearer's own hair lowers due to the decrease of the area where the wearer's own hair can be bound and held, the clipping force required to fix the wig to a head can not be attained.

Therefore, as the length in the horizontal direction suitable to the clip for a wig is preferably about 3 to 6 cm as the straight line distance connecting both ends in the horizontal direction.

Embodiment 2

The clip for a wig of the second embodiment of the present invention is explained next.

Figure 17:
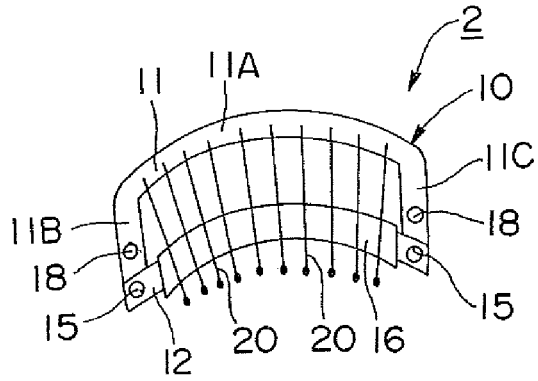
FIG. 17 illustrates a clip for a wig in accordance with the second embodiment of the present invention.

FIG. 17 illustrates the clip for a wig of the second embodiment, and the clip 2 for a wig of the present embodiment is characterized to be attached to a wig base 30 via a sheet. Here, the same constituent members as in the clip 1 for a wig of the embodiment 1 are numbered with identical numbers, and the details of its explanation are omitted.

The clip 2 for a wig in accordance with the present embodiment is provided with penetration holes 18 for attaching the sheet to respective leg portions 11B and 11C of the reversible member 10, and such connecting pieces as metal eyelets and rivets are inserted to said penetration holes 18, thereby the sheet is attached to the clip 2 for a wig.

Figure 18:
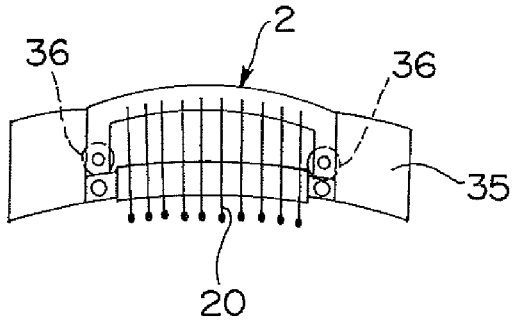
FIG. 18 illustrates the state of a sheet attached to the clip for a wig of FIG. 17.
Figure 19:
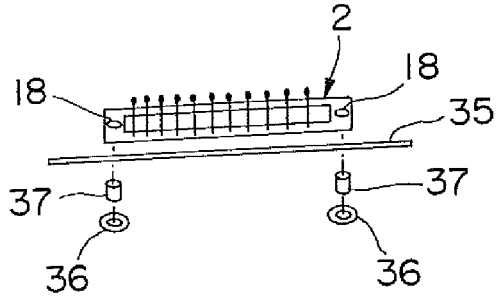
FIG. 19 is the diagnosis drawing of FIG. 18.

FIG. 18 illustrates the state of a sheet 35 attached to the clip 2 for a wig of the present embodiment, and FIG. 19 is the diagnosis drawing of FIG. 18. As shown in these figures, the sheet 35 is attached to the clip 2 for a wig by providing the sheet 35 to the reverse side of the clip 2 for a wig, providing a washer 36 at the position of the penetration hole 18, binding the sheet 35 with said washer 36 and the clip 2 for a wig, and inserting the connecting piece 37 to the penetration hole 18 and the washer 36.

The sheet 35 is made of the same material as the wig base 30, and, for example, if the wig base 30 is made of urethane resin, then the same urethane sheet is preferable. The size of said sheet 35 is designed as appropriate to attach the clip 2 for a wig to the side which contacts the head of the wig base 30.

Figure 20:
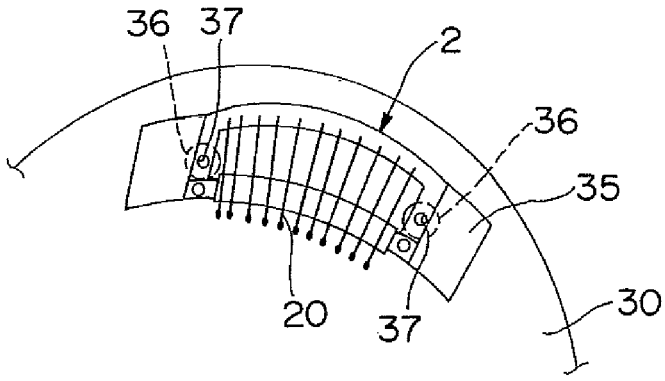
FIG. 20 illustrates the state of the clip for a wig shown in FIG. 17 attached to a wig base.

The sheet 35 attached to the clip 2 for a wig is bonded with double stick tape, or an adhesive is coated thereon, thereby it can be bonded to the reverse side of the wig base 30 as shown in FIG. 20. In this case, the sheet 35 is bonded to the reverse side of the wig base 30 so that the outer shape of the clip 2 for a wig, that is, the periphery of the support portion 11A comes along the curved shape of the periphery of the wig base 30.

Thus, by using the sheet 35, the clip 2 for a wig can be easily attached to the wig base 30. Also, in the case that the clip 2 for a wig is directly attached to the wig base 30, for example, the connecting piece 37 inserted in the penetration hole 18 is fixed also to the wig base 30, and the connecting piece 37 is possibly visible from outside, but in the present embodiment, since the sheet 35 is located between the clip 2 for a wig and the wig base 30, exposure of the connecting piece 37 to outside is avoided.

The position of the penetration hole 18 in the clip 2 for a wig of the second embodiment is explained next.

Figure 21:
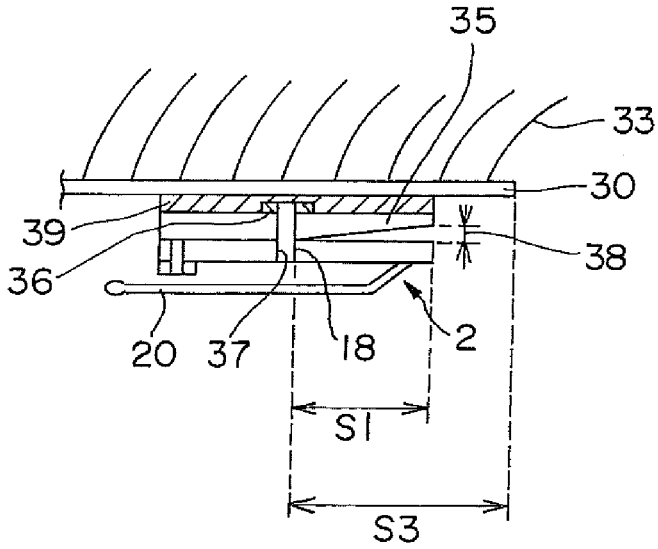
FIG. 21 is a cross-sectional view schematically illustrating the state of the clip for a wig shown in FIG. 17 attached to the reverse side of the wig base.

In the clip 2 for a wig of FIG. 17, the penetration holes 18 are located at the positions toward the connecting portion 12 of the leg portions 11B and 11C. FIG. 21 is a cross-sectional view schematically illustrating the state of the clip 2 for a wig shown in FIG. 17 attached to the reverse side of the wig base 30.

As described before, the sheet 35 is attached to the clip 2 for a wig with the connecting piece 37. More concretely, the portion of the sheet 35 is fixed at the corresponding position of the two penetration holes 18 of the clip 2 for a wig with the two connecting pieces 37, but the reverse side except for the two penetration holes of the clip 2 for a wig is not fixed on the sheet 35.

Therefore, in the state wherein the sheet 35 fixed to the clip 2 for the wig is attached to the wig base 30 via the adhesive layer 39, as shown in FIG. 21, since the gap 38 is generated because the sheet 35 and the clip 2 for a wig are not closely contacted in the region S1 from the side end of the periphery of the wig base 30 of the clip 2 for a wig to the connecting piece 37, as a result, the wig base 30 and the sheet 35 may possibly warp up in the region S3 from the periphery of the wig base 30 to the connecting piece 37.

Figure 22:
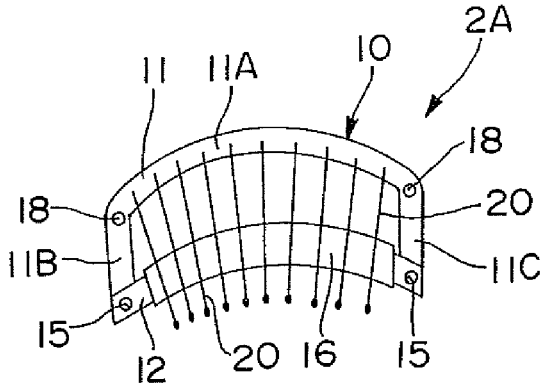
FIG. 22 illustrates the clip for a wig in accordance with the second embodiment of the present invention.

On the other hand, the penetration hole 18 may be provided at the position toward the support portion 11A of the leg portions 11B and 11C as shown in FIG. 22. Since the clip 2A for a wig shown in FIG. 22 has the constitution practically identical with that of the clip 2 for a wig shown in FIG. 17, the explanation in detail is omitted.

In the clip 2A for a wig shown in FIG. 22, like the clip 2 for a wig shown in FIG. 17, the sheet 35 can be attached to the reverse side of the clip for a wig by disposing the washer 36 at the position of the penetration hole 18 to bind the sheet 35, and inserting the connecting piece 37 into the penetration hole 18 and the washer 36, and the sheet 35 can be bonded to the reverse side of the wig base 30 by bonding a double stick tape, or by coating an adhesive to the adhesive surface of the sheet 35 to the wig base 30.

Figure 23:
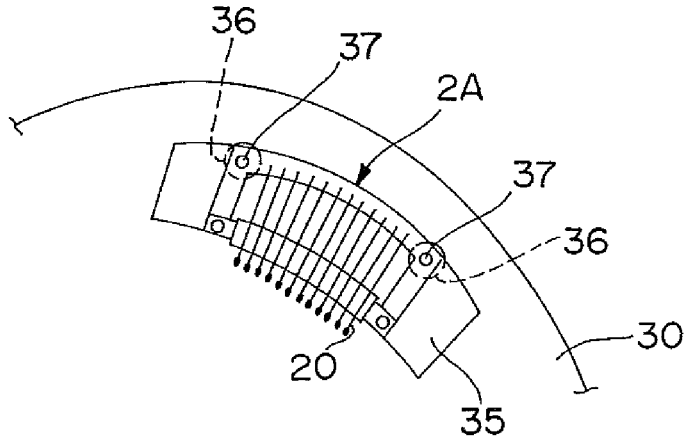
FIG. 23 illustrates the state of the clip for a wig shown in FIG. 22 attached to a wig base.
Figure 24:
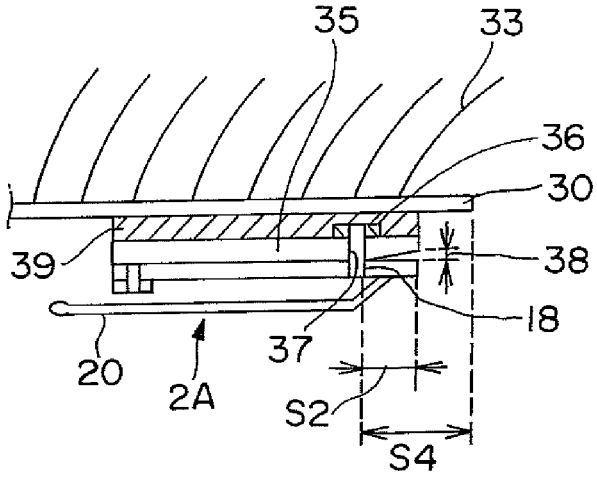
FIG. 24 is a cross-sectional view schematically illustrating the state of the clip for a wig shown in FIG. 22 attached to the reverse side of the wig base.

FIG. 23 illustrates the state of the clip 2A for a wig shown in FIG. 22 attached to the reverse side of the wig base 30, and FIG. 24 is a schematic cross-sectional view of FIG. 23. Here, the position of the clip 2A for a wig in FIG. 23 is same as that of the clip 2 for a wig in FIG. 20.

In the attached state shown in FIG. 23, the sheet 35 is fixed in the portion corresponding to the position of the two penetration holes 18 of the clip 2A for a wig with the two connecting pieces 37, but the reverse side except for the two penetration holes of the clip 2A for a wig is not fixed to the sheet 35. Therefore, as shown in FIG. 24, in the state wherein the sheet 35 fixed to the clip 2A for a wig is attached to the wig base 30 via the adhesive layer 39, since the gap 38 is generated because the sheet 35 and the clip 2 for a wig are not in close contact in the region S2 from the side end of the periphery of the wig base 30 of the clip 2A for a wig to the connecting piece 37, as a result, the wig base 30 and the sheet 35 may possibly warp up in the region S4 from the periphery of the wig base 30 to the connecting piece 37. In this case, since the penetration hole 18 of the clip 2A for a wig is disposed toward the support portion 11A, that is, on the fixed side of the comb teeth, compared with the above-mentioned penetration hole 18 of the clip 2 for a wig, the distance from the periphery of the wig base 30 to the connecting piece 37 is, as shown in FIGS. 23 and 24, shorter than the case of the above-mentioned clip 2 for a wig. That is, the region S2 is smaller than the region 51. Thereby, the clip 2A for a wig can prevent warping up from the wig base 30 compared with the clip 2 for a wig, and can make the range narrow where warping up of the wig base 30 occurs.

Thus, by disposing the penetration hole 18 to fix the sheet 35 to the clip for a wig on the side of the comb teeth, the effect to prevent warping up of the wig base 30 can be further improved by making the support portion 11A curving.

The reversing force of the clip 2 for a wig shown in FIG. 17 and the clip 2A for a wig shown in FIG. 22 is explained, comparing with the conventional clip 100 for a wig shown in FIG. 30.

Figure 25:
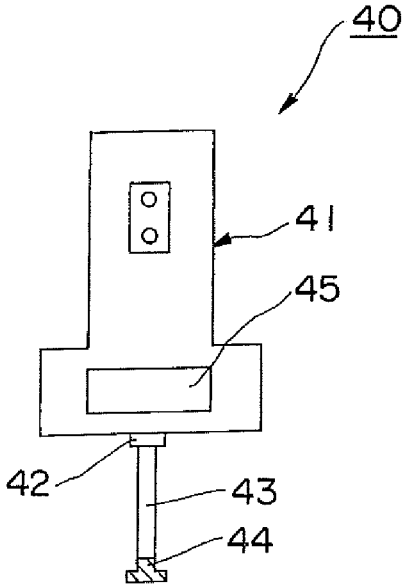
FIG. 25 is a schematic view illustrating a measuring apparatus used for measuring reversing force.

FIG. 25 is a schematic view illustrating a measuring apparatus 40 used for measuring reversing force, and this measuring apparatus 40 is provided with an extension rod 43 and a contact terminal 44 in a load detecting device 42 of the measuring part 41. As the measuring apparatus 40 used for the measurement of reversing force, Digital Forceguage DFG-1K (Shimpo Kogyo Inc.) was used.

Figure 26:
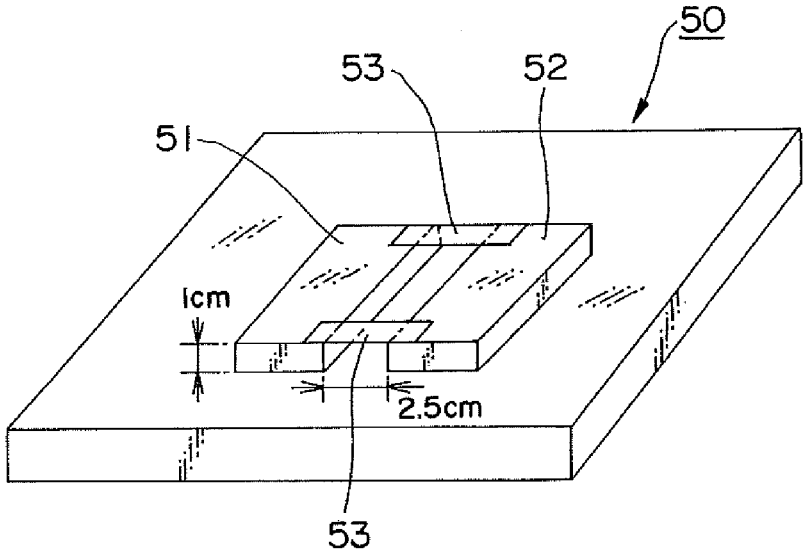
FIG. 26 is a schematic view illustrating a stage used for measuring reversing force.

FIG. 26 is a schematic view illustrating a stage 50 used for measuring reversing force of the clip for a wig, and the stages 50 are arranged at about 2.5 cm intervals on about 1 cm thick hard rubber plates 51 and 52 on a flat place such as a desk. The clip for a wig is set so as to bridge between two stages 50 with its both ends fixed with a tape (illustration omitted) to respective rubber plates 51 and 52, and the reversing force is measured in this state. Here, upon measurement, the rubber plates are mutually connected with a tape 53 so that the respective rubber plates 51 and 52 of the stages 50 do not move.

Figure 27:
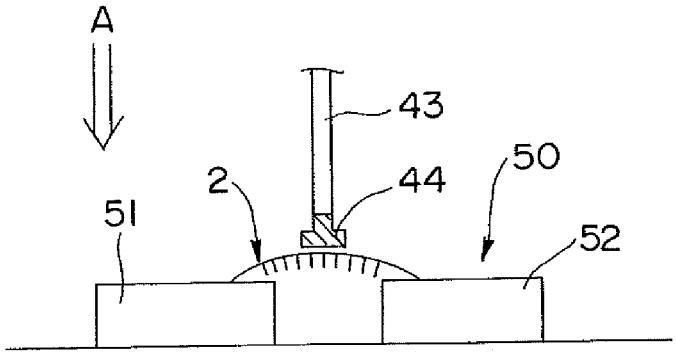
FIG. 27 illustrates the state of the clip for a wig fixed on the stage in accordance with the embodiment of the present invention.

FIG. 27 is a side view illustrating the state of the clip 2 for a wig fixed on the stage 50, wherein the clip 2 for a wig is closed, and the tips of the comb teeth 20 are closely contacted to the connecting portion 12. The both ends of the clip 2 for a wig are fixed with a tape (illustration omitted) to the stage 50 so that the comb teeth side comes at the lower side. In this state, the contact terminal 44 provided to the tip of the extension rod 43 of the measuring apparatus 40 is contacted to the clip 2 for a wig. Then, the initial load of about 100 gf is applied at a dash to the contact terminal 44 in the direction of an arrow A so that the tips of the comb teeth 20 separate from the connecting portion 12, it is confirmed that the numerical value displayed on the display 45 has been stabilized to a constant value, and then the clip 2 for a wig is pushed and pressed. When the tips of the comb teeth 20 are separated from the connecting portion 12, the numerical value displayed on the display 45 of the measuring apparatus 40 is read. Hereinafter, this measurement is referred to as the measurement 1.

Figure 28:
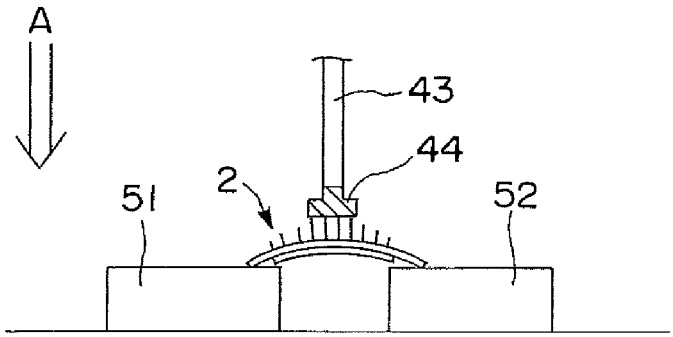
FIG. 28 illustrates the state of the clip for a wig fixed on the stage in accordance with the embodiment of the present invention.

FIG. 28 is a side view illustrating the state of the clip 2 for a wig fixed on the stage 50, wherein the clip 2 for a wig is opened, and the tips of the comb teeth 20 are separated from the connecting portion 12. The both ends of the clip 2 for a wig are fixed with a tape (illustration omitted) to the stage 50 so that the comb teeth side comes at the upper side. In this state, the contact terminal 44 provided to the tip of the extension rod 43 of the measuring apparatus 40 is contacted to the clip 2 for a wig. Then, the initial load of about 100 gf is applied at a dash to the contact terminal 44 in the direction of an arrow A so that the tips of the comb teeth 20 are pressed and come to contact with the connecting portion 12, it is confirmed that the numerical value displayed on the display 45 has been stabilized to a constant value, and then the clip 2 for a wig is pushed and pressed. When the tips of the comb teeth 20 are pressed and come to contact with the connecting portion 12, the numerical value displayed on the display 45 of the measuring apparatus 40 is read. Hereinafter, this measurement is referred to as the measurement 2.

The results of said measurements 1 and 2 are shown in Table 1 for the clip 2 for a wig shown in FIG. 17, the clip 2A for a wig shown in FIG. 22, and the conventional clip 100 for a wig shown in FIG. 30.

TABLE 1

| | Measurement type | |
|---|---|---|
| Clip type | 1 | 2 |
| Clip 2 for a wig shown in FIG. 17 | 411 | 331 |
| Clip 2A for a wig shown in FIG. 22 | 432 | 350 |
| Conventional clip for a wig shown in FIG. 30 (Hard) | 503 | 410 |
| Conventional clip for a wig shown in FIG. 30 (Soft) | 260 | 188 |

Here, as for conventional clips for wigs shown in FIG. 30, hard and soft are regarding the reversing forces of the clips for wig. The one that has a strong reversing force is defined as hard, and the one of weak force as soft. In this regard, a conventional clip for a wig (Soft) has the hair-clipping force sufficient as an accessory to clip and fix the wig wearer's own hair to the head.

As shown in this table, the clips 2 and 2A for wigs shown in FIGS. 17 and 22 have no big difference in the reversing forces in spite of the different positions of the connecting holes 18.

It is also seen that, compared with the conventional clip for a wig shown in FIG. 30 (Hard), the reversing forces of the clips 2 and 2A for wigs shown in FIGS. 17 and 22 are weak, but strong compared with the conventional clip for a wig (Soft). Therefore, the clips 2 and 2A for wigs shown in FIGS. 17 and 22 have hair-clipping force sufficient for use for wig wearing.

A Modified Version of Embodiment 2

The clip for a wig of a modified version of the second embodiment of the present invention is explained next.

Figure 29:
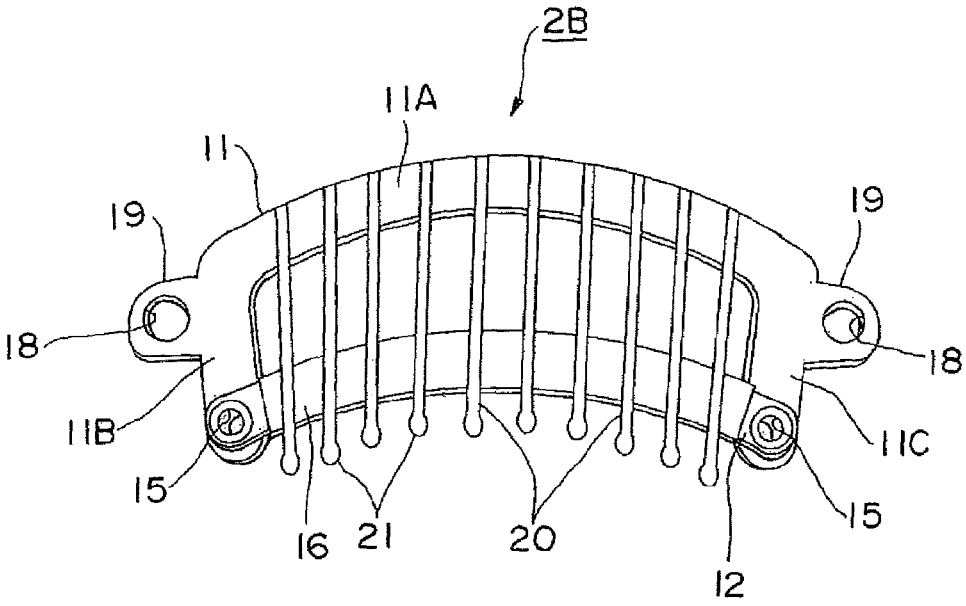
FIG. 29 illustrates the clip for a wig in accordance with the modified version of the second embodiment.

FIG. 29 is a view illustrating a clip 2B for a wig of a modified version of the second embodiment. On the clip 2B for a wig, the penetration hole 18 to attach a sheet is formed in the attaching portion 19 extending outward from leg portions 11B and 11C of a reversible member 10. Here, the same constituting components as those of the clips 2 and 2A for a wig in accordance with the second embodiment are marked with identical marks and symbols, and their explanation in detail is omitted.

The clip 2B for a wig of the present embodiment has a penetration hole 18 for a sheet attaching on the attaching portion 19 extending from respective leg portions 11B and 11C of a reversible member 10, and a sheet 35 is attached to the clip 2B for a wig by inserting such a connecting piece 37 as a metal eyelet and a rivet into this penetration hole 18.

Said clip 2B for a wig can be attached without the sheet 35, by being sewn directly to the wig base 30, inserting a sewing thread through the penetration hole 18.

In the illustrated example, the attaching portion 19 is provided at the position toward the support portion 11A of the leg portions 11B and 11C, but the position of the attaching portion 19 is not limited to the illustrated example, but may be toward the connecting portion 12 of the leg portions 11B and 11C. Each attaching portion 19 is not limited as integrally constituted with each leg portion 11B and 11C, but the individually manufactured attaching portion 19 may be attached to each leg portion 11B and 11C.

The present invention can be carried out in various embodiments within the range of its essential feature. The case was explained where the clip for a wig is attached around the swelling turned back portion at the rear position behind the forehead hairline corners of the wig base 30, but not limited only to this, it can be constituted corresponding to the curved shape of the periphery of the wig base. In this case, the outer shape of the curved reversible member of the clip for a wig, more concretely, the outer shape of the support portion is curved and formed with the curvature corresponding to said other peripheral curve. The reversible member of the clip for a wig may also be constituted by connecting the two L-shaped or U-shaped frame materials, respectively.

What is claimed is:

1. A clip for wig, constituted with a frame-like reversible member; a plurality of comb teeth attached to the reversible member; and a sheet for attaching to a wig base, wherein;

the outer shape of said reversible member is formed in a circular arc along a curved periphery of the wig base, wherein said reversible member is formed reversibly in a curved frame-shaped with a U-shaped frame material having a support portion supporting said plurality of comb teeth held at each one end and a pair of leg portions protruding in one direction from both ends of said support portion and a connecting portion pulling both leg portions of said U-shaped frame material inwardly, and the outer shape of said support portion is formed in a circular arc along the curved periphery of the wig base, wherein the outer shape of said connecting portion is formed in the same shape as the outer shape of a circular arc of said support portion, penetration holes are formed at a plurality of positions toward said support portions in the respective leg portions, and into said penetration holes a plurality of connecting pieces are inserted to hold the sheet on a reverse side of said reversible member, said sheet being attached to said wig base, and said sheet is longer than said reversible member, extending beyond the respective leg portions.

2. The clip for wig as set forth in claim 1, wherein;

the outer shape of said support portion is formed into a curve with a curvature of about a same level as the periphery of extending from a circular wig extending from a hairline corner of a forehead portion of the wig base.

3. The clip for wig as set forth in claim 1 or 2, wherein;

the outer shape of said support portion is formed in a circular arc with the curvature radius of 1.5 cm to 4.5 cm.

4. A wig, provided with a clip for wig, wherein;

said clip for wig is constituted with a frame-like reversible member, a plurality of comb teeth attached to the reversible member, and a sheet for attaching to a wig base, wherein the outer shape of said reversible member is formed in a circular arc along a curved periphery of the wig base, wherein said reversible member is formed reversibly in a curved frame-shaped with a U-shaped frame material having a support portion supporting said plurality of comb teeth held at each one end and a pair of leg portions protruding in one direction from both ends of said support portion and a connecting portion pulling both leg portions of said U-shaped frame material inwardly, and the outer shape of said support portion is formed in a circular arc along the curved periphery of the wig base, wherein the outer shape of said connecting portion is formed in the same shape as the outer shape of a circular arc of said support portion, penetration holes are formed at a plurality of positions toward said support portions in the respective leg portions, and into said penetration holes a plurality of connecting pieces are inserted to hold the sheet on a reverse side of said reversible member, said sheet being attached to said wig base, and said sheet is longer than said reversible member, extending beyond the respective leg portions.

5. The wig as set forth in claim 4, wherein;

forehead hairline corners are formed at least at either left or right side of said wig base.

* * * * *